US010373723B2

(12) United States Patent
Tompson, Jr. et al.

(10) Patent No.: US 10,373,723 B2
(45) Date of Patent: Aug. 6, 2019

(54) ISOTOPE ENERGY CONVERSION AND SPENT NUCLEAR FUEL STORAGE SYSTEMS

(71) Applicant: The Curators of the University of Missouri, Columbia, MO (US)

(72) Inventors: Robert V. Tompson, Jr., Columbia, MO (US); Mark A. Prelas, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 915 days.

(21) Appl. No.: 14/870,845

(22) Filed: Sep. 30, 2015

(65) Prior Publication Data

US 2016/0093411 A1 Mar. 31, 2016

Related U.S. Application Data

(60) Provisional application No. 62/057,620, filed on Sep. 30, 2014.

(51) Int. Cl.
*G21H 1/12* (2006.01)
*G21F 5/008* (2006.01)

(52) U.S. Cl.
CPC ..... *G21H 1/12* (2013.01); *G21F 5/008* (2013.01)

(58) Field of Classification Search
CPC ... G21H 1/12; G21H 3/00; G21H 3/02; G21F 5/008; G21F 5/02; G21F 5/10
See application file for complete search history.

(56) References Cited

U.S. PATENT DOCUMENTS 3,031,519 A * 4/1962 Silverman ..... G21H 1/12 136/253
3,483,040 A * 12/1969 Parkins ..... G21H 1/12 136/253
5,082,505 A * 1/1992 Cota ..... G21H 1/12 136/244
8,552,616 B2 * 10/2013 Prelas ..... G21H 1/06 136/253
9,305,674 B1 * 4/2016 Wertsching ..... G21H 1/12
2011/0259399 A1 * 10/2011 Shinkai ..... H01L 31/055 136/247
2013/0269741 A1 * 10/2013 Lang ..... H01L 35/30 136/205

* cited by examiner

*Primary Examiner* — Sharon M Davis
(74) *Attorney, Agent, or Firm* — Greer, Burns & Crain, Ltd.; Steven P. Fallon

(57) ABSTRACT

The invention provides methods, devices and systems for excimer fluorescence energy conversion from isotopes. Unprocessed spent nuclear fuel can be used as an isotope, and processed spent nuclear fuel can be used as an isotope. A method includes placing an excimer in the path of radiation decay from the isotope. The excimer is selected according to the isotope to absorb the radiation decay and emit photons in response. Surrounding environment is shielded from the radiation decay. Photons generated from the fluorescence of the excimer are received with photovoltaic material to generate electrical energy. The electrical energy is applied to a load. Systems of the invention can be based upon spent storage casks and handle unprocessed spent nuclear fuel, or can be greatly reduced in size and handle processed fuel, with single isotope isolation allowing consumer battery sized systems.

15 Claims, 9 Drawing Sheets

Lightpipe shield

ISOTOPE ENERGY CONVERSION AND SPENT NUCLEAR FUEL STORAGE SYSTEMS

PRIORITY CLAIM AND REFERENCE TO RELATED APPLICATION

This application claims priority under 35 U.S.C. § 119 from prior pending U.S. Provisional Application Ser. No. 62/057,620, which was filed on Sep. 30, 2014.

FIELD

Fields of the invention include energy conversion, spent nuclear reactor fuel storage, and spent nuclear reactor fuel storage casks. A preferred example application of the invention is a system that recovers energy from spent nuclear fuel assemblies in dry storage casks. Another example application of the invention is a system that recovers energy from processed isotopes obtained from spent nuclear reactors, including processed isotopes that have been physically reprocessed into smaller physical sizes such as rods, wires, strips, or tubes. Another example application of the invention is a system that recovers energy from individual isotopes obtained from spent nuclear reactors, including systems that are reduced to the physical size of common consumer batteries.

BACKGROUND

Spent nuclear reactor fuel is a huge problem for power companies and state and local governments. The storage of spent nuclear reactor fuel poses threats and security risks. Efforts and regulations have focused on the safe storage of spent nuclear reactor fuel in secret and hardened facilities. Early storage efforts placed spent nuclear fuel assemblies and rods in pools located in hardened and secret buildings. More recently, spent nuclear reactor fuel dry storage casks have been developed to secure and store spent nuclear reactor fuel assemblies. The casks are hardened to withstand bomb strikes and terrorist threats. The casks include passive cooling fins to dissipate heat generated by the decay of the spent nuclear reactor fuel, and are also structured to contain radiation generated by the decay. The casks may be stored in the open, or in buildings, or underground locations that may include additional external cooling to aid heat dissipation. The focus of all efforts to store and secure spent nuclear fuel has been safe containment of the fuel to prevent accidental or deliberate radiation releases and structures have been designed with this in mind to withstand both attacks and catastrophes. No emphasis has yet been placed on designs intended to realize, benefits from the such stored spent nuclear fuel.

In the United States, there are 103 commercial nuclear reactors that generate about 20% of the total electrical energy used in the United States each year, which is about 3% of the total energy used in the United States each year. The average age of these reactors is in excess of 25 years and the typical reactor undergoes a complete fuel change-out about every 3-4 years with the used (spent) fuel elements (assemblies) typically being stored on site in spent fuel storage pools protected by secret locations and hardened buildings. This represents a great deal of spent nuclear reactor fuel. The addition of nuclear capacity in the United States remains possible as efforts seek to reduce dependency of the nation's energy supply upon fossil fuels. Increase in nuclear power capacity will further increase the amount of spent fuel storage required.

The Nuclear Waste Policy Act (NWPA; as amended) stipulates that the federal government (DOE) will take title to the spent fuel from these reactors and will place it into permanent geological storage at the *Yucca* Mountain site in Nevada. Even with the enabling legislation for this disposal in place and the needed funds ($22B) having been collected as a surcharge on nuclear electricity sales over the years, still Congress has refused to actually appropriate the funds to implement the geological disposal in Yucca Mountain as is required by the NWPA. Thus, spent fuel assemblies have continued to accumulate in spent fuel storage pools at the various reactor sites around the US to the point that the storage pools at many sites are filled to capacity.

Transferring ownership of spent fuel and the physical transporting of spent fuel are either not allowed under the current NWPA or are subject to intense public/political opposition. This has led utilities to implement alternative storage options for spent fuel such as the dry cask storage cask. These casks are quite large, to accommodate the unprocessed size of spent fuel assemblies. The outer portion of the cask is in the range of 20-30 feet in height with a diameter of about 10 feet. The outer portion encloses an inner canister, and a bundle of spent fuel assemblies is within the inner canister. Shielding protects against emissions from the case, and fan systems are used to cool the cases.

Spent fuel assemblies consist of about 95% unburned enriched uranium, plutonium, and other transuranic species (all potential future fuels) and about 5% isotope species and their decay byproducts (some very scarce and industrially valuable). The isotopes in spent fuel include species that decay very rapidly (hours or days), species that decay with medium rapidity (10's to 100's of years), and species that decay very slowly (1000's to millions of years). Following removal from a reactor and about 1 year spent cooling off in the spent fuel storage pool, a spent fuel assembly can have enough radioactivity still present to result in the generation of heat equivalent to about 0.1% of its operational power while still in the reactor. Thus, a typical spent fuel assembly from a Westinghouse PWR such as the Callaway Plant in Fulton, Missouri will still be producing thermal power of roughly 150-200 kiloWatts from the radioactive decays of the isotopes and transuranic species after 1 year of storage. At present, this energy is simply dissipated via passive and active cooling to maintain safety of the spent nuclear reactor fuel.

Spent nuclear fuel is not presently reprocessed in the U.S. Reprocessing plants have been previously build in the U.S., but various regulations and test failures long ago caused U.S. plants to be shut down. Reprocessing is conducted in other countries. Various products can be obtained by reprocessing spent fuel, but these depend upon the fuel, its initial enrichment, and the time the fuel has been used. As an example, reprocessed U-238 will normally have less than 1% U-235 (typically about 0.5% U-235) and also smaller amounts of U-232 and U-236 created in the reactor. The U-232 has daughter nuclides which are strong gamma-emitters. The primary idea behind present reprocessing efforts is to repurpose the reprocessed fuel to be used again as part of a re-enriched fuel source in a nuclear reactor. Generally, spent fuel of a reactor is processed to obtain a concentrated metal oxide. The concentrated oxide generally includes, as a small percentage of an array of other elements, including both isotopes and actinides formed in the reactor. Further processing can obtain isolate specific isotopes.

SUMMARY OF THE INVENTION

The invention provides methods, devices and systems for excimer fluorescence energy conversion from isotopes. Preferred embodiments use unprocessed spent nuclear fuel as an isotope, and other embodiments use processed spent nuclear fuel as an isotope.

A preferred method of converting isotope radiation decay energy into electrical energy includes placing an excimer in the path of radiation decay from the isotope. The excimer is selected according to the isotope to absorb the radiation decay and emit photons in response. Surrounding environment is shielded from the radiation decay. Photons generated from the fluorescence of the excimer are received with photovoltaic material to generate electrical energy. The electrical energy is applied to a load.

A preferred isotope energy recovery system includes a shielded containment vessel and reflective surfaces within the containment vessel. An isotope is within the containment vessel and an excimer is in the path of radiation decay from the isotope. The excimer is selected according to the isotope to absorb the radiation decay and emit photons in response. A photovoltaic cell is disposed to receive the photons. Connections are external to the vessel for a load to draw power from the photovoltaic cell.

A preferred method of converting isotope radiation decay energy from a spent nuclear fuel source into electrical energy includes isolating the spent nuclear fuel source in a container. Surrounding environment is shielded from the radiation decay. The radiation decay is received with a wide bandgap material that includes a radiation shield with a high density rare gas radioactive isotope micro bubble to convert the radiation into electrical energy. The electrical energy is applied to a load.

DESCRIPTION OF THE PREFERRED EMBODIMENTS

Figure 1:
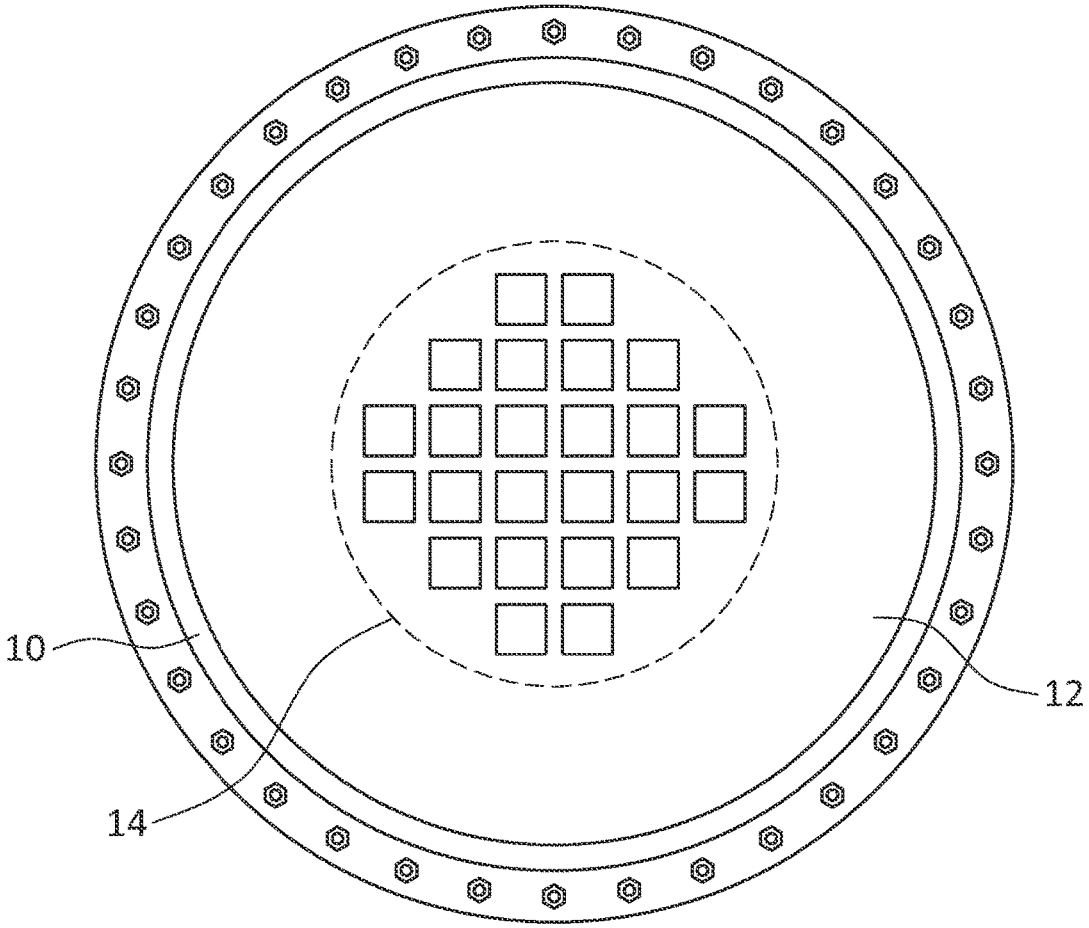
FIGS. 1 and 2 are respectively top and side cross-section schematic diagrams of a preferred embodiment isotope energy conversion system that can use unprocessed spent nuclear fuel as an energy source and is based upon a spent nuclear fuel storage cask configuration.

Preferred embodiments of the invention provides methods, devices and systems for fission produce energy conversion. In energy conversion methods, devices and systems of the invention, a photovoltaic cell generates electricity from isotopes. In some embodiments, a two step conversion is used, with an excimer fluorsecer first producing photons that are then converted to electricity by a photovoltaic cell. In other embodiments the energy conversion is via a p-n junction of a wide bandgap material including a radiation shield with a high density rare gas radioactive isotope micro bubble. The high density causes excimer states in the rare gas radioactive isotope that decay to produce photons, and the photos stimulate the p-n junction to produce electrical current.

In preferred embodiments, photons are generated by exposing an excimer flourescer to radiation. The excimer flourescer converts the energy of the radiation from the radioactive decays into UV or visible photons. Preferred excimer flourescers include Ar, Kr, Xe, ArF, ArCl, KrF, KrCl, XeF, XeCl as well as a number of other known excimer flourescers. The fluorescence photons are then converted into electricity using the photovoltaic cells (wide band-gap or traditional semiconductors depending on the fluorescence source).

Particular preferred embodiments of the invention provide methods, devices and systems to recovery usable electrical energy from spent nuclear fuel in dry storage casks. With methods, devices and systems of the invention, significant useful energy is recovered from the decay of spent nuclear reactor fuel contained in such casks. The useful energy can be supplied to an electrical power grid or used internally at a power plant, which is a likely location for the installation of such conversion systems. In some embodiments, the spent nuclear fuel can be unprocessed and in the form currently stored in casks or cooling pools in the United States. In other embodiments, the spent nuclear fuel is a processed concentrate, or a specific component of a processed concentrate, such as a specific isotope.

Preferred embodiment methods, devices and systems are based upon excimer fluorescence photovoltaic energy conversion. A two-step process allows the choice of the radioisotope to be made, which limits the potential impact of the radioisotope to the environment due to an accidental release. In a first step, an excimer fluorescer absorbs emissions from a fission source. In a second step, a photovoltaic cell absorbs photos and generates electricity. The electricity can be supplied to an external load via electrodes connected to the photovoltaic cell.

A preferred embodiment is an excimer fluorescence energy converter device. A container includes excimer fluorescence generator that is driven by a fission source. The fission source in preferred embodiments is a reprocessed spent nuclear fuel, and in other embodiments is an unprocessed spent nuclear fuel. The container is sized according to the fuel and the need for effective shielding of personnel and equipment. For individual products isolated from spent nuclear fuel, such as alpha emitting transuranic isotopes (e.g. Pu-238, Am-241, Cm-244, Cf-250) with only low probability or low energy beta emissions or fission product isotopes involving only low probability or low energy beta emissions, the container can be as small as a consumer sized AA battery. A photovoltaic cell is disposed to receive photon emissions from the excimer fluorescence generator and generates electricity from the fluorescence products of the fluorescence generator. The radioisotope conversion method is an efficient, two-step process which first converts the radiation from the isotope into UV fluorescence photons (or to visible fluorescence photons depending upon which excimer mixture is used) from an excimer flourescer (Ar, Kr, Xe, ArF, ArCl, KrF, KrCl, XeF, XeCl as well as other potential excimer flourescers) and then, converts the fluorescence photons into electricity using the photovoltaic cells (wide band-gap or traditional semiconductors depending upon the fluorescence source). The excimer flourescer can be a liquid or gas contained within a photovoltaic material lined (or which otherwise contains appropriate photovoltaics) container that surrounds the spent nuclear fuel. Alternatively, the excimer flourescer and photovoltaic cell can be in a specific portion of the container, e.g., a top portion connected to external electrodes. Preferably, internal surfaces are highly reflective to help photons reach the photovoltaic collector.

Preferred embodiment systems can handle unprocessed spent nuclear fuels. Certain preferred embodiments include a modified or newly constructed spent nuclear fuel storage cask that includes a two-step energy conversion system of the invention. A spent nuclear fuel storage cask is constructed or modified to include an excimer fluorescence generator that is driven by the decay products of the spent nuclear fuel. The excimer fluorsecer is dimensioned and configured to be contained in the cask, such as within the inner canister and having the same general shape as the cask. The excimer flourescer (e.g, Ar, Kr, Xe, ArF, ArCl, KrF, KrCl, XeF, XeCl as well as other potential excimer flourescers) can be a liquid or gas contained within a photovoltaic material lined inner cannister that surrounds the spent nuclear fuel.

Other photovoltaic energy conversion mechanisms can also be used. In preferred embodiments, a wide bandgap material includes a radiation shield with a high density rare gas radioactive isotope micro bubble. The high density causes excimer states in the rare gas radioactive isotope that decay to produce photons, and the photos stimulate the p-n junction to produce electrical current). This conversion structure can be incorporated into the containers mentioned above, ranging from the AA battery size containers to spent nuclear fuel storage cask sizes. Details about this type of energy conversion are disclosed in Prelas et al., U.S. Pat. No. 8,552,616, which is incorporated herein.

Preferred embodiments of the invention will now be discussed with respect to the drawings. The drawings may include schematic representations, which will be understood by artisans in view of the general knowledge in the art and the description that follows. Features may be exaggerated in the drawings for emphasis, and features may not be to scale.

Figure 2:
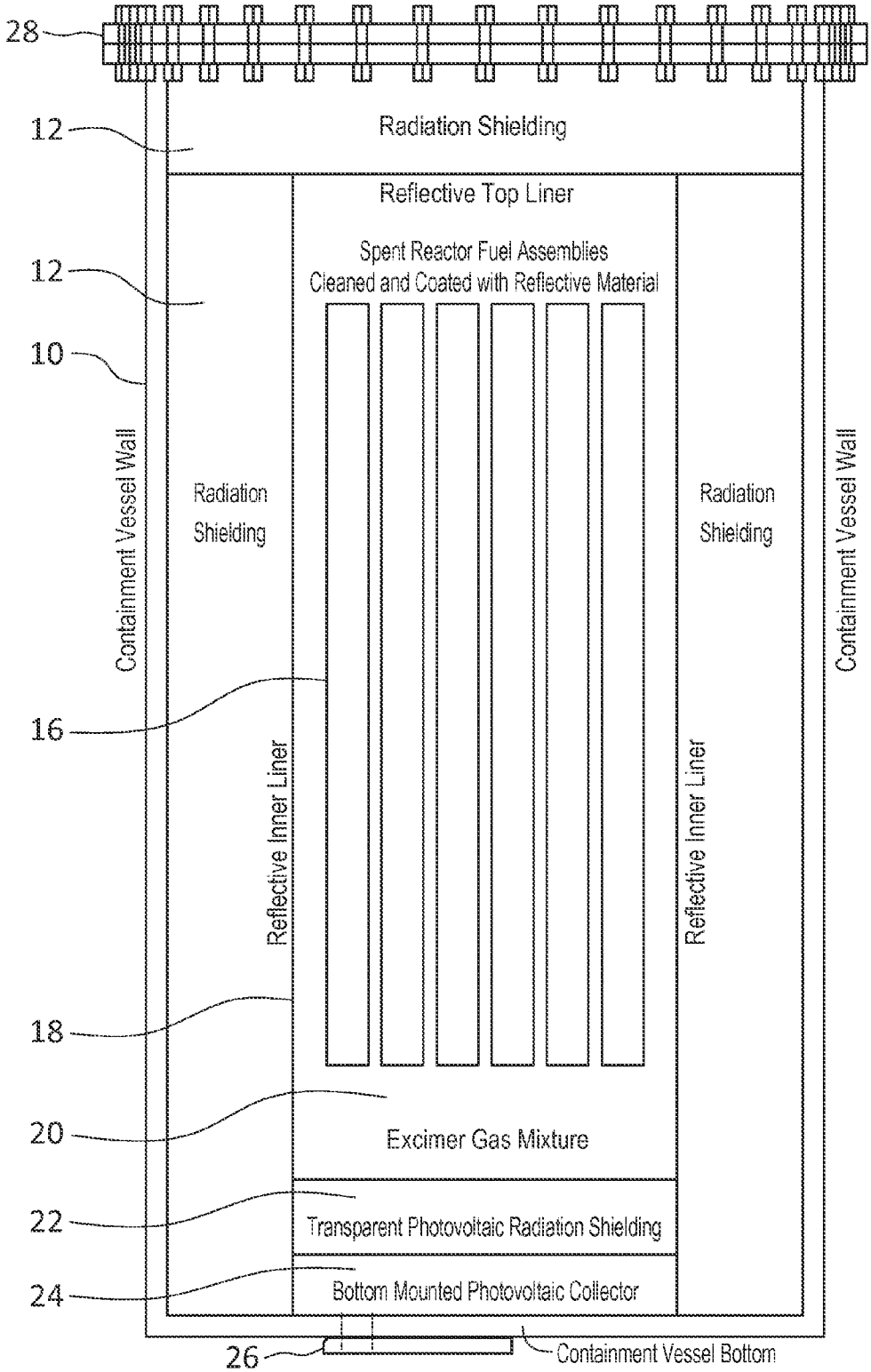

FIGS. 1 and 2 illustrate a preferred embodiment isotope energy conversion system that is based upon a spent nuclear fuel storage cask configuration. A containment vessel 10 includes radiation shielding 12 surrounding (circumference 14 and top) a fission source 16 in the form unprocessed spent fuel assemblies in a reflective liner 18. Aluminum is a preferred reflective material. An excimer gas mixture 20 is contained within the liner and transparent photovoltaic radiation shielding protects 22 a bottom mounted photovoltaic collector 24. The excimer gas mixture 20 is preferably chosen from gases mentioned above and the collector 24 is preferably a standard photovoltaic, most preferably with the widest bandgap obtainable. An electrical connection box 26 provides connection to electric feeds through the containment vessel to collect power output of the collector. The containment vessel 10 is sealed with a cover 28 that is bolted in place, and can be the same outer structure as a conventional spent nuclear fuel storage cask that is in widespread use to store spent nuclear fuel rods that have been removed from service in nuclear reactors in the United States. The embodiment provides a high efficiency with the arrangement and the reflective liner 18 that helps to maximize the absorption of photons by the collector 24.

Figure 3:
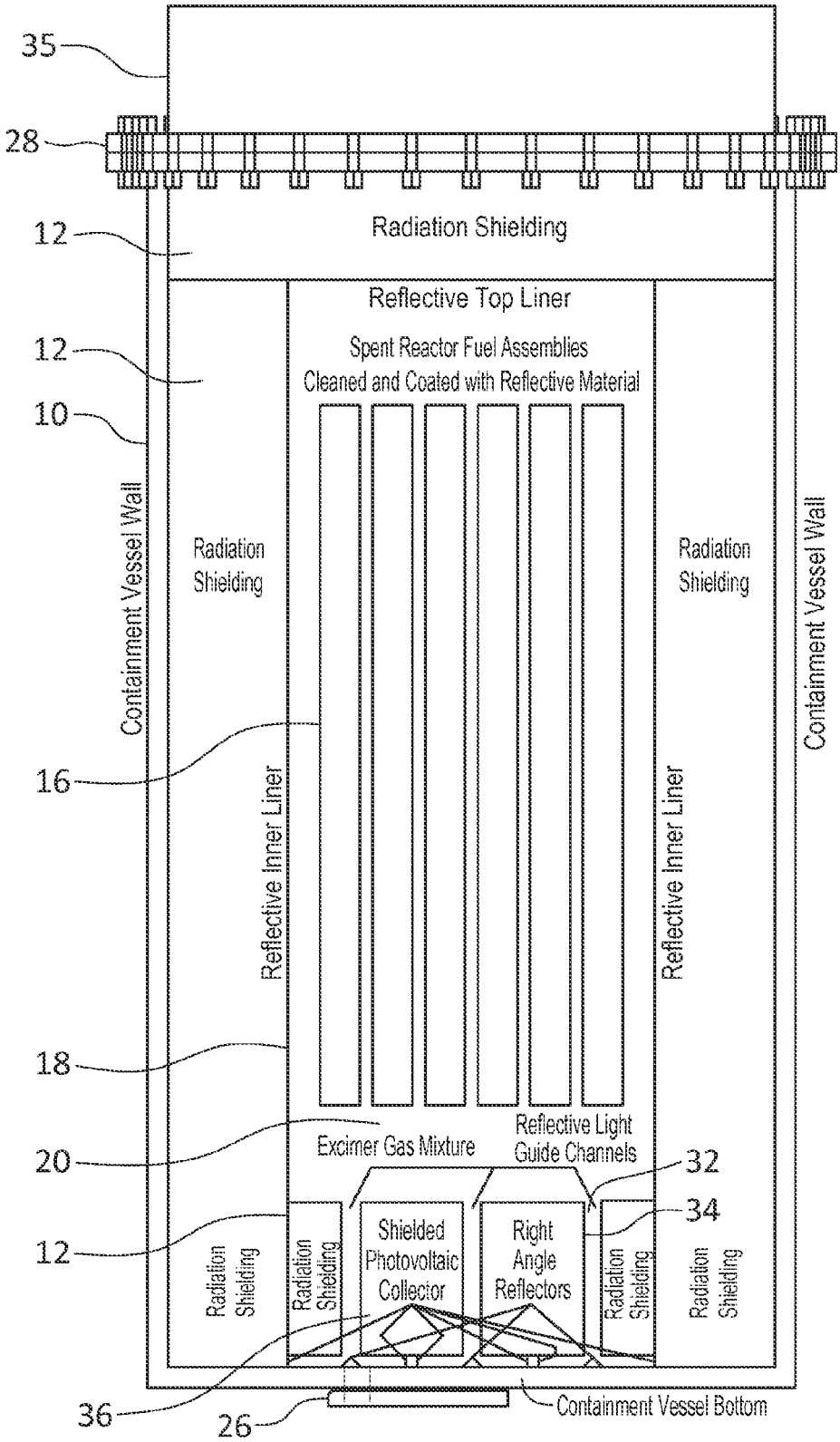
FIG. 3 is a side cross-section schematic of another preferred embodiment isotope energy conversion system.

FIG. 3 shows an embodiment that is a variation of the FIGS. 1 and 2 embodiment. The same reference numerals are used to indicate like parts. The FIG. 3 conversion system includes reflective light guide channels 32 and reflectors 34 at the bottom of the containment vessel 10 for directing energy toward shielded photovoltaic collectors 36. This allows photons to be directed toward the photovoltaic collectors from multiple sides, which can provide benefits in terms of improved overall excimer photon collection efficiency. Many other configurations of reflectors, spent fuel materials, and photovoltaics are feasible that can result in improved efficiency with the overall efficiency of collection being primarily dependent on the total number of reflections a photon would likely undergo before being absorbed by the photovoltaic element. The number of reflections is preferably minimized since each reflection also involves a chance that the photon will be absorbed by the reflective material. Aluminum is a preferred reflective material because it has the lowest probability of photon absorption over the widest range of photon frequencies.

A hybrid energy harvesting system includes an excimer photovoltaic photon converter coupled to a secondary system that generates energy from heat can generate substantial electricity. FIG. 3 illustrates a heat to energy conversion device 35 that can increase overall system efficiency. In addition to the photovoltaic energy conversion, the hybrid system uses secondary energy conversion of the device 35 to take advantage of any remaining heat that is generated. The heat can be directed toward any device capable of using the heat directly that can convert heat. One example technology is the Radioisotope Thermoelectric Generator (RTG), which NASA routinely uses to power deep space probes. Another example heat conversion device that can be used to convert excess heat is the Stirling engine. With very high theoretical efficiencies, practical Stirling engines can be 15%-30% efficient in harvesting waste heat and, when compared to internal combustion engines, are capital cost competitive up to about 100 kiloWatts.

Figure 4:
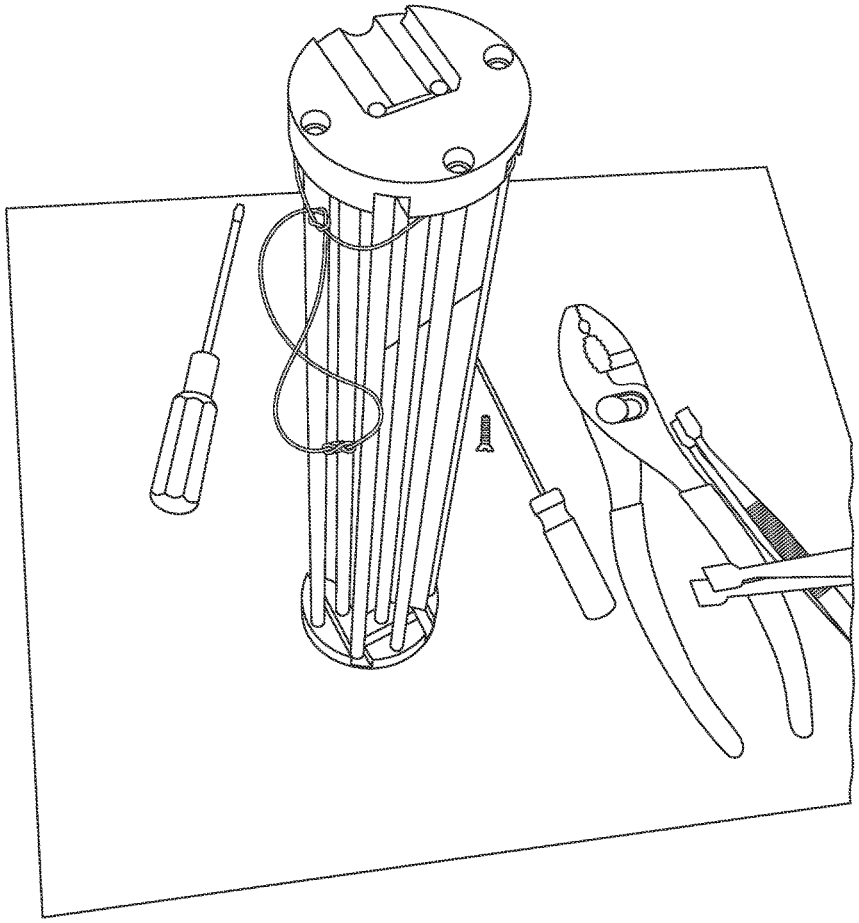
FIG. 4 is a photograph of a table top sized energy conversion device of the invention.

The containment vessel 10 and other components can be the downsized, for example, to tabletop or consumer battery sized packages such as AA packages when the fission source 16 is a reprocessed to an appropriate size. Experimental models have demonstrated the ability of table top sized packages and AA battery size packages to provide shielding, reflection, excimer conversion and photovoltaic collection of photons to output electrical energy. FIG. 4 illustrates a table top sized energy conversion device of the invention that can accommodate reprocessed spent nuclear fuel that is compact enough to fit within the table top sized vessel. These models have demonstrated that excimer photon production is of a magnitude that is expected given the source strengths of the fuel materials used, that the photon transport within the models is both functional as expected and of a magnitude that is reasonable to expect, that the conversion of the excimer photons to electrical power via the photovoltaics occurs with efficiencies that are reasonable and expected and produces currents and voltages as expected, and that the system is capable for operating for extended periods without failure of the photovoltaics due to radiation damage.

The inventors have estimated efficiencies for conversion in the case of the nuclear fuel storage cask embodiments. Depending upon the geometry of the assemblies inside the storage casks, about 1-40% of the energy available from the decay process of the spent nuclear fuel can be harvested via the process of excimer fluorescence in conjunction with photovoltaic (solar) cells. Excimers (excited dimers) are bound 2-atom structures that exist only in an energetically excited state. Noble gases such as argon, krypton, and xenon form such structures when excited (both by themselves and in combination with various other species) but, when unexcited, exist only as simple 1-atom species incapable of bonding with any other atomic species. When an excimer de-excites and breaks back up into two atoms, it emits a characteristic frequency of light. This emitted light is known as fluorescence and can be converted directly to electricity using photovoltaic cells. The maximum theoretical efficiency of this conversion is about 47% of the decay energy with the remainder of the energy manifesting itself in the system as heat. Conventional storage casks waste all of the energy that is emitted however, in the form of dissipated heat that is released from the casks.

A unit employing the invention that applies the energy conversion to an existing cask and essentially unmodified spent fuel assemblies would probably yield only about 1%-5% efficiency, which is at the lower end of the expected harvesting range but which would be sufficient to provide benefit. A modified cask design that included rearranging and repacking, or reprocessing the spent fuel assemblies is likely to be able to achieve 15%-20% efficiency. Higher efficiencies above this level would require optimized photovoltaic cell materials, but these materials continue to advance. The inventors believe that some existing materials (such as aluminum nitride) may, with some work, be able to yield about 35%-40% overall efficiency in an otherwise optimized system.

Significant energy can be recovered with devices, systems and methods of the invention. With a single cask containing about 24 spent fuel assemblies and giving off about 3-4 MegaWatts of power constantly, a 40% recovery would equate to about 1.5 MegaWatts of electrical power generated per storage cask. Actual performance will depend upon the actual inventories of isotopes and transuranic species in the individual spent fuel assemblies and their ages as measured from the times they were extracted from the reactor with their overall available power dropping off exponentially in time.

A closed system with the photovoltaic cell is prone to radiation damage even from beta emitters. Photovoltavic materials such as Si, SiC, III-V (e.g., GaN and AlN) are subject to the radiation displacing atoms in the lattice. The radiation damage in these materials cannot be annealed because the original crystal structure will not reform. Diamond crystals, on the other hand, can be reformed through annealing. Self-annealing to avoid radiation damage is likely limited to diamond photovoltaic cells. As casks may be taken off-line after a period of use when their energy production is reduced to a predetermined level, the photovoltaic cell may be thick enough for such uses such that radiation damage is not a concern.

Figure 5:
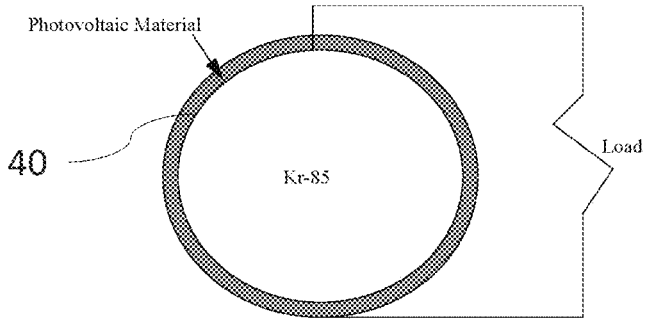
FIGS. 5-7 are schematic diagrams illustrating preferred devices and methods for recovering energy from reprocessed fuel which can be used within the energy conversion systems of FIGS. 1-4.
Figure 6:
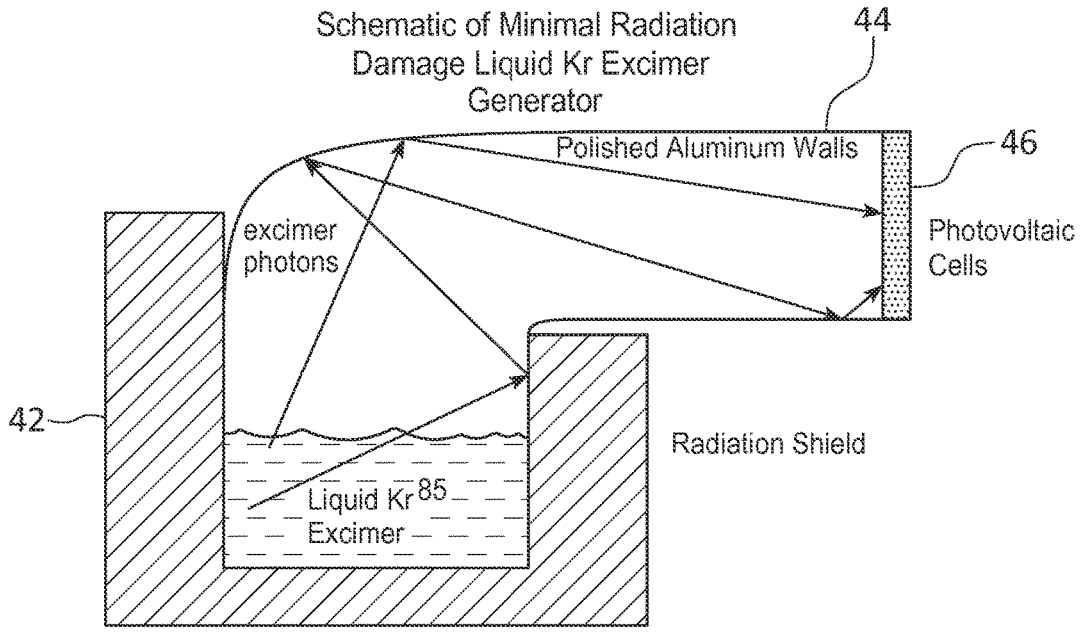
Figure 7:
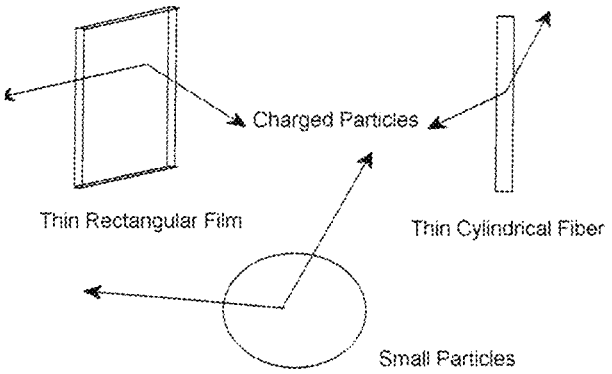

FIGS. 5-7 illustrate preferred devices and methods for recovering energy from reprocessed fuel. The devices of FIGS. 5-7 can be used within energy conversion devices of FIGS. 1-4. The FIG. 6 embodiment is formed as a cylinder 40 and provides energy recovery from Kr-85 as an excimer, which is a product of nuclear fission reactors currently vented directly to the atmosphere. Radioactive Krypton being used this way would require very high pressure containment or cryogenic temperatures or both. The photovoltaic cell 40 generates electricity from the fluorescence products. Isotopes can be introduced as a gas as in FIG. 5.

Isotopes can also be solid or liquid. A surrounding photovoltaic cell may also be shielded, but the shielding should provide for effective photon transport to the cell meaning that it must be as transparent as possible to the excimer photons being generated. Many different common materials could be used for this purpose depending on the energies of the excimer photons. Fused silica is one good possibility for transparent shielding material.

FIG. 6 illustrates a configuration for recovering energy from liquid Kr-85 excimer. The liquid isotope is contained in a shielded tank 42. A light pipe 44 contains the excimer liquid/gas and is polished for reflecting photons toward photovoltaic cells 46. The photovoltaic cells 46 are preferably shielded for longer life. Photons are directed to the photovoltaic cell via the light pipe 46 which directs the photons around the intervening shielding. This photon redirection around shielding can also be accomplished with simple reflective surfaces (mirrors) if desired and the light pipe is simply an example of a continuous reflector for the excimer photons. The liquid excimer and radiation shield prevent most of the decay radiation from spent nuclear fuel (which would be contained in the shield within the containment vessel 10) from reaching the photovoltaic cells 46.

FIG. 7 shows another method of shielding the photovoltaic cells. Specifically, solid isotopes (or solids containing spent fuel isotopes) can act as shields, when the solid isotopes provide high transport efficiencies for photon transport to a photovoltaic cell. This transport can be via transparency to the excimer photons or can be due to the use of the solid isotopes in highly reflective forms (such as aluminum alloys etc.)

Artisans will appreciate that a variety of different excimers, in the forms of liquid, solid or gas can be used. Some excimers will provide particular advantages over others. For example, Kr-85 is a preferred isotope because it is chemically inert, it disperses if released (it is gaseous) and, if it enters the body, it does so through the lungs where it has virtually no biological half-life. It is produced as a byproduct of fission and is considered safe enough that it is released to the atmosphere from commercial power plants and fuel reprocessing facilities.

Indirect photo conversion methods can be used to protect p-n junction photovoltaic cells used in any of the above embodiments. FIGS. 6 and 7 provide examples. Photons are transported either by lightpipes or through a gas shield plenum to a wide band-gap photovoltaic cell. Using VUV (Vacuum UltraViolet) light from a rare-gas excimer provides a conversion process that is capable of high efficiencies. Charged particles interact with the excimer gas to produce photons at high efficiency and reduce potential radiation damage to the p-n junction by transporting the photons through or around a shield material. The photons can then be harvested by the p-n junction via the photovoltaic effect. In this process, Xe or Kr are concentrated at high densities. The charged particle released in the isotope decay process interacts with the surrounding Xe or Kr atoms to form excited states and ions. At rare gas densities of about one half of an atmosphere (STP), these states preferentially form the rare gas excimer state. The excimer then decays by the emission of a photon (for Xe 7.2 eV for Kr 8 eV). The overall efficiency of the process is approximately 47-50%. The Ar excimer is also about 50% efficient with a 9.6 eV photon.

Figure 8:
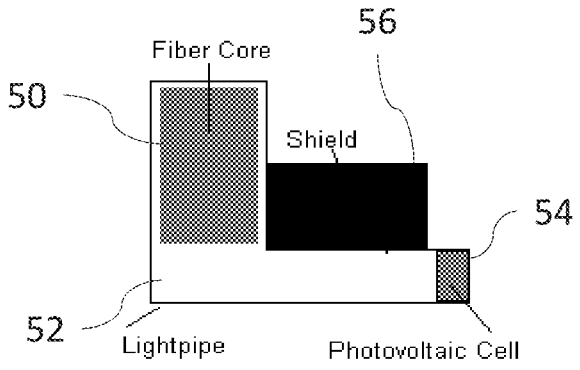
FIG. 8 illustrates a preferred embodiment lightpipe shielding strategy usable with the preferred devices of FIGS. 1-4.

FIG. 8 illustrates an example light pipe shielding strategy that can be used to protect the photovoltaic cells. The fission source isotope is loaded in a fiber 50. This fission source isotope can be embedded in the fiber or can be used as one of the fiber constituent materials. Typically, such fibers are fabricated of various glasses with differing levels of impurity to create a graduated index of refraction that will guide photons. One is illustrated, but a system in accordance with FIGS. 1-4 will include many fibers 50. Photons are reflected in a highly reflective light pipe 52 toward a photovoltaic cell(s) 54. The cell(s) 54 are protected via a shield 56, which can be a solid. The lightpipe arrangement of FIG. 8 will shield alpha, beta and gamma particles from the photovoltaic cell(s). Fission source isotopes can also be mounted in fibers that are not waveguides.

Figure 9:
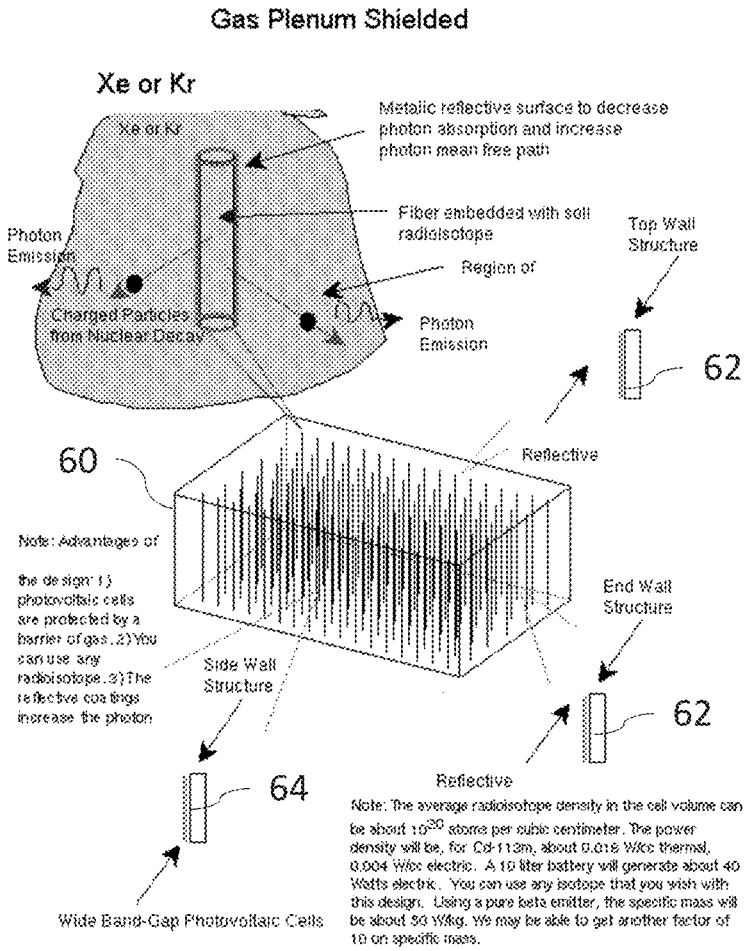
FIG. 9 illustrates a preferred embodiment gas plenum shielding strategy usable with the preferred devices of FIGS. 1-4

FIG. 9 illustrates a gas plenum shielding strategy. A reflective inner vessel 60 contains reflective inner surfaces 62 on some walls (e.g. top and end walls) and wide bandgap photovoltaic cells 64 on other surfaces (e.g. side walls). The reflective inner vessel 60 of FIG. 9 is a rectangular cross-section vessel (the reflective vessel in FIGS. 1-4 included a circular cross-section), while other cross-sections are possible. Some alternative shapes might provide better reflection/collection of photons by the photovoltaic cells 64. The reflective vessel 60 includes isotope sources in the form of fibers 68 embedded with radioisotopes. The fibers 68 include a reflective outer surface 70 (such as a metal like aluminum) to avoid re-absorption of photons. The vessel is filled with a gas plenum shield 72 contained under positive pressure within the inner vessel 60. Suitable gases for the plenum shield/excimer fluorescer include Xe, Kr and other gasses that will absorb isotopes and emit photons. The gas plenum shield if sufficiently thick will shield alpha and beta particles. Thick in this context implies a sufficient mass density between the radioactive materials and the photovoltaics to stop the radiations from reaching the photovoltaics Estimations of mass, scale and power decay have been conducted for liquid Kr-85, as the excimer fluorescer with Sr-90, Po-210 and Pu-238 isotope sources. The geometry is assumed to be spherical with a diameter equal to the system scale estimation. Photovoltaic cells are assumed to surround the fluorescer media and the vessel is shielded with lead. The estimates showed that all of the isotope sources except Po-210 would generate significant (kW) power over periods well beyond 40 months with an effectively linear power decay. Po-210 provides significant power, but with an obviously exponential decay that is short lived (estimated at less than 30 months). The spherical geometry and liquid Krypton excimer fluorescer were chosen as reasonable optima for these estimations.

A large number of isotopes can be used to provide fission product isotope sources. Some of these are themselves by-products of fission in nuclear reactors or can be produced with nuclear reactors or accelerators from isotopes not originating in nuclear fission processes. Use of fission products directly is preferred simply because so much material currently exists unused in spent fuel storage facilities which can be readily reprocessed. A list of example preferred RECS (RadioIsotope Energy Conversion System) isotopes is shown in Table 1. All of the isotopes listed in Table 1 can be obtained from reprocessed spent nuclear fuel. Table 2 includes long-lived isotopes of the Table 1 isotopes and Table 3 medium-lived isotopes.

TABLE 1

List of Preferred Example Isotopes

| Isotope | Half Life Years | β Energy MeV (% if less than 100) | γ Energy MeV (%) | State 300K | Production |
|---|---|---|---|---|---|
| Ar-39 | 269 | 0.565 | None | gas | Neutrons on KCl & Ar-38 (n, γ) |

TABLE 1-continued

List of Preferred Example Isotopes

| Isotope | Half Life Years | β Energy MeV (% if less than 100) | γ Energy MeV (%) | State 300K | Production |
|---|---|---|---|---|---|
| Se-79 | $6.5 \times 10^4$ | 0.16 | None | solid | Fission |
| Kr-85 | 10.76 | 0.67 | 0.514 (0.41%) | gas | Kr-84 (n, γ) and fission |
| Rb-87 | $4.8 \times 10^{10}$ | 0.274 | none | solid | Fission |
| Sr-90 | 27.7 | 0.546 | none | solid | Fission |
| Zr-93 | $1.5 \times 10^6$ | 0.06 | none | solid | Fission |
| Tc-99 | $2.12 \times 10^5$ | 0.292 | none | solid | Fission |
| Pd-107 | $7 \times 10^6$ | 0.04 | none | solid | fission |
| Cd-113m | 13.6 | 0.58 | none | solid | fission |
| Sn-121m | 76 | 0.42 | 0.037 | solid | fission |
| Pm-147 | 2.62 | 0.224 | none | solid | fission |
| Gd-148 | 84 | 3.18 α | none | solid | Sn-147(α, 3n) |
| Gd-150 | $2.1 \times 10^6$ | 2.73 α | none | solid | Daughter Eu-150 |
| Eu-155 | 4.76 | 0.252 | 0.087 (32%) 0.105 (20%) | solid | fission |
| Hf-182 | $9 \times 10^6$ | 0.5 | 0.271 (84%) | solid | fission |

TABLE 2

Long-lived isotopes

| | Prop: | | | |
|---|---|---|---|---|
| | $t^{1/2}$ | Yield | Q | βγ |
| | Unit: | | | |
| | Ma | % | keV | * |
| Tc-99 | 0.211 | 6.1385 | 294 | β |
| Sn-126 | 0.230 | 0.1084 | 4050 | βγ |
| Se-79 | 0.295 | 0.0447 | 151 | β |
| Zr-93 | 1.53 | 5.4575 | 91 | βγ |
| Cs-135 | 2.3 | 6.9110 | 269 | β |
| Pd-107 | 6.5 | 1.2499 | 33 | β |
| I-129 | 15.7 | 0.8410 | 194 | βγ |

TABLE 3

Medium-lived isotopes

| | Prop: | | | |
|---|---|---|---|---|
| | $t^{1/2}$ | Yield | Q | βγ |
| | Unit: | | | |
| | a | % | keV | * |
| Eu-155 | 4.76 | 0.0803 | 252 | βγ |
| Kr-85 | 10.76 | 0.2180 | 687 | βγ |
| Cd-113m | 14.1 | 0.0008 | 316 | β |
| Sr-90 | 28.9 | 4.505 | 2826 | β |
| Cs-137 | 30.23 | 6.337 | 1176 | βγ |
| Sn-121m | 43.9 | 0.00005 | 390 | βγ |
| Sm-151 | 90 | 0.5314 | 77 | β |

An example commercial nuclear generating station is the Callaway Plant near Fulton, Mo. This reactor has 193 fuel assemblies in the core. When spent, the fuel assemblies could be used as is in cask-style embodiments of the invention like those in FIGS. 1-3. Alternatively, the fuel assemblies could be re-processed to extract Sr-90 and Cs-137. These could be used as sources in a highly reflective alloy form. A zirconium and aluminum alloy should work well in a Sr-90 converter since the Sr decays to Zr.

With the selection and optimization of geometries and isotopes, a high level of efficiency can be achieved. What the maximum efficiency level is would be uncertain in general but would depend on the specific type and energy of the source radiation, the eximer photon energy (which is dependent in turn on the excimer used), and the desired size and geometry of the system. Many possible relative optima are possible for a given system given a set of constraints on the product. Since each potential application is unique, a careful optimization must be undertaken for each application after all of the constraints are identified.

Particular preferred embodiments, especially for battery sized embodiments use alpha-emitting radioisotopes, which are appropriate for use in a nuclear battery. Preferred examples are described in Table 4. Polonium-210 is used an example here:

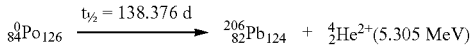

$$^{0}_{84}Po_{126} \xrightarrow{t_{1/2} = 138.376\ d} {}^{206}_{82}Pb_{124} + {}^{4}_{2}He^{2+}(5.305\ MeV)$$

Alpha particles are swift heavy ions whose interactions with matter are governed by the Bethe-Bloch stopping power equation. The range of an alpha particle (e.g., 9.32 micrometers in uranium) will be greater than the range of a fission fragment in uranium metal (4.22 micrometers for a heavy fission fragment and 6.29 micrometers for a light fission fragment) due to its lower charge and mass. The ionization produced by an alpha particle along its path in a solid will follow a classical Bragg curve with a Bragg peak, whereas a fission fragment has no Bragg peak, due to the highly changing linear energy transfer of fission fragments as it picks up electrons during the slowing down process. Further, the range of any charged particle is a function of the electron density of the stopping material, such that less dense materials provide a lower stopping power than higher density materials. For example, the range of 5 MeV alpha particles in air is 40.6 mm (as compared to 9.32 micrometers in uranium metal). Therefore, it is often instructive to consider ranges in terms of areal density, which is the linear range divided by the density of the material. The availability of long-lived, portable supplies in battery sizes of table top sizes at useful power levels based on radioisotopes can provide a reliable energy source for remote applications. Such power supplies have military, homeland defense and civilian applications as well as applications for space-based systems such as power requirements for deep space missions. The benefit of using many of the candidate radioisotopes listed in Table 4, as well as other isotopes, is that the many of the isotopes that devices, systems and method of the invention can use are produced in nuclear fission.

TABLE 4

α sources for nuclear batteries. The criteria used in identifying these isotopes is based on a half-life between 0.379 years and 100 years. Other emissions are shown such as gamma emission (for which additional shielding would be needed).

| Nuclide | Z | N | Decay Energy (MeV) | Half life (Years) | Other emissions (MeV, %) | Production Reactions |
|---|---|---|---|---|---|---|
| Gd-148 | 64 | 84 | 3.182 | 74.6 | N/A | Sm-147(α, 3n)<br>Eu-151(p, 4n) |
| Po-208 | 84 | 124 | 5.216 | 2.8979 | $\beta^+$: 0.3783 (0.00223%) | Bi-209(d, 3n)<br>Bi-209(p, 2n) |
| Po-210 | 84 | 126 | 5.305 | 0.379 | γ: 0.803 (0.0011%) | Natural source |
| Th-228 | 90 | 138 | 5.52 | 1.9131 | α: 5.340 (27.2%)<br>5.423 (72.2%)<br>γ: 0.216(0.25%) | Natural source |
| U-232 | 92 | 140 | 5.414 | 68.9 | α: 5.263 (31.55%)<br>5.32 (68.15%)<br>γ: 0.1-0.3 (low %) | Pa-232(β)<br>Th-232(α, 4n) |
| Pu-236 | 94 | 142 | 5.867 | 2.857 | α: 5.721 (30.56%)<br>5.768 (69.26%) | Np-236(β)<br>U-235(α, 3n) |
| Pu-238 | 94 | 144 | 5.593 | 87.74 | α: 5.456 (28.98%)<br>5.499 (70.91%) | Np-238(β)<br>Np-237(n, γ) |
| Am-241 | 95 | 146 | 5.638 | 432.2 | α: 5.442 (13%)<br>5.485 (84.5%)<br>γ: 0.05954 (35.9%) | Pu-241(β) |
| Cm-243 | 96 | 147 | 6.168 | 29.1 | α: 5.742(11.5%)<br>5.785 (72.9%)<br>5.992 (5.7%)<br>6.058 (4.7%)<br>γ: 0.2-0.3 (20%) | Multiple-n capture<br>U-238, Pu-239 |
| Cm-244 | 96 | 148 | 5.902 | 18.1 | α: 5.762 (23.6%)<br>5.805 (76.4%)<br>γ: low percentage | Multiple-n capture<br>U-238, Pu-239, Am-243 |
| Bk-248 | 97 | 151 | 5.793 | 9 | | Cm-246(α, pn) |
| Cf-250 | 98 | 152 | 6.128 | 13.07 | α: 6.0304 (84.6%)<br>5.989 (15.1%)<br>γ: 0.04285 (0.014%) | Multiple-n capture<br>U-238, Pu-239, Cm-244 |
| Cf-252 | 98 | 154 | 6.217 | 2.645 | SF: FF (3.092%<br>α: 6.0758 (15.7%)<br>6.118 (84.2%)<br>γ: 0.043-0.155 (0.015%) | Multiple n capture<br>U-238, Pu-239, Cm-244 |
| Es-252 | 99 | 153 | 6.739 | 1.292 | α: 6.5762 (13.6%)<br>6.632 (80.2%)<br>γ: 0.043-0.924 (25%) | Bk-249(α, n)<br>Cf-252(d, 2n) |

Table 5 shows beta sources. The criteria used in identifying these isotopes is based on a half-life between 1 year and 269 years.

TABLE 5

Potential $\beta^-$ sources for nuclear batteries. Other emissions are shown such as gamma emission (for which additional shielding would be needed).

| Nuclide | Z | N | Decay Energy (MeV) | Half life (Years) | $\beta_{max}$ (MeV) | Other emissions (Units in MeV) | Production Method |
|---|---|---|---|---|---|---|---|
| H-3 | 1 | 2 | 0.019 | 12.33 | 0.019 | N/A | Li-6(n, α) |
| Ar-39 | 18 | 21 | 0.565 | 269 | 0.565 | N/A | Ar-38(n, γ)<br>KCl(n, γ) |
| Ar-42 | 18 | 24 | 0.6 | 32.9 | 0.6 | N/A | Ar-40(n, γ)<br>Ar-41(n, γ) |
| Co-60 | 27 | 33 | 2.824 | 5.2713 | 0.318 | γ: 1.17 (99%)<br>1.33 (0.12%) | Co-59(n, γ) |
| Kr-85 | 36 | 49 | 0.67 | 10.755 | 0.67 (99.6%)<br>0.15 (0.4%) | γ: 0.514 (0.4%) | Fission product |
| Sr-90 | 38 | 52 | 0.546 | 28.77 | 0.546 | 2.281<br>(Y-90, daughter) | Fission product |
| Ru-106 | 44 | 62 | 0.039 | 1.0234 | 0.039 | N/A | Fission product |
| Cd-113m | 48 | 65 | 0.58 | 14.1 | 0.58 | N/A | Cd-112(n, γ)<br>Cd-113(n, n') |
| Sb-125 | 51 | 74 | 0.767 | 2.73 | 0.7667 | γ: 0.5 (5-20%) | Sn-124(n, γ) |
| Cs-134 | 55 | 79 | 2.058 | 2.061 | 0.662 (71%)<br>0.089 (28%) | γ: 0.6-0.8 (97%) | Cs-133(n, γ) |
| Cs-137 | 55 | 82 | 1.175 | 30.1 | 1.176 (6.5%)<br>0.514 (93.5) | γ: 0.6617 (93.5%) | Fission Product |
| Pm-146 | 61 | 85 | 1.542 | 5.52 | 0.795 | γ: 0.747 (33%) | Nd-146(p, n)<br>Nd-148(p, 3n) |
| Pm-147 | 61 | 86 | 0.225 | 2.624 | 0.225 | N/A | Nd-146(n, γ) |
| Sm-151 | 62 | 89 | 0.076 | 90 | 0.076 | N/A | Fission product |
| Eu-152 | 63 | 89 | 1.822 | 13.54 | 1.818 | γ: 0.1-0.3 | Eu-151(n, γ) |
| Eu-154 | 63 | 91 | 1.969 | 8.592 | 1.845 (10%)<br>0.571 (36.3%)<br>0.249 (28.59%) | γ: 0.123 (38%),<br>0.248 (7%),<br>0.593 (6%),<br>0.724 (21%),<br>0.759 (5%),<br>0.876 (12%),<br>1.0 (31%),<br>1.278 (37%) | Eu-153(n, γ) |
| Eu-155 | 63 | 92 | 0.253 | 4.67 | 0.147 (47.5%)<br>0.166 (25%)<br>0.192 (8%)<br>0.253 (17.6%) | γ: 0.086 (30%)<br>0.105 (21%) | Sm-154(n, γ) |
| Tm-171 | 69 | 102 | 0.096 | 1.92 | 0.0964 (98%)<br>0.0297 (2%) | γ: 0.0667 (0.14%) | Er-170(n, γ) |
| Os-194 | 76 | 118 | 0.097 | 6 | 0.0143 (0.12%)<br>0.0535 (76%)<br>0.0966 (24%) | γ: 0.01-0.08 | Os-192(n, γ)<br>Os-193(n, γ) |
| Tl-204 | 81 | 123 | 0.763 | 3.78 | 0.763 | N/A | Tl-203(n, γ) |
| Pb-210 | 82 | 128 | 0.063 | 22.29 | 0.0169 (84%)<br>0.0635 (16%) | γ: 0.046 (4%) | Natural source |
| Ra-228 | 88 | 140 | 0.046 | 5.75 | 0.0128 (30%)<br>0.0257 (20%)<br>0.0392 (40%)<br>0.0396 (10%) | γ: low E (low %) | Natural source |
| Ac-227 | 89 | 138 | 0.044 | 21.773 | 0.02 (10%)<br>0.0355 (35%)<br>0.0448 (54%) | α: 4.953 (47.7%)<br>4.940 (39.6%)<br>γ: 0.1 to 0.24 γ | Ra-226(n, γ) |
| Pu-241 | 94 | 147 | 0.021 | 14.35 | 0.02082 | α: 4.853 (12.2%)<br>4.896 (83.2%) | Multiple-n capture<br>U-238, Pu-239 |

Alpha and beta emitters are preferred that do not emit gamma rays due to potential shielding concerns. For instance, if Co-60 is utilized in a beta-based nuclear battery, then for 1 mW of power, assuming a 100% conversion efficiency and complete escape of the high energy gamma rays, would require 1.76 Ci. The associated high energy gamma ray radiation from this large activity limits its suitability in many situations where radiation effects to surrounding materials (e.g. electronics) and personnel is of importance. This is particularly true for microscale nuclear batteries, where the shielding required to reduce the gamma-ray flux to acceptable levels oftentimes severely reduces the overall energy density ($W_e$/kg) of the battery, which also increases the battery footprint as a consequence. Thus, avoiding gamma emissions reduces demand on the shielding.

The choice of material for the photovoltaic cell will also effect system efficiency. In the case of radiation interactions with a solid, electron-hole pairs are created as well as heat. The eximer photons being used as a conversion mechanism are one form of such radiation. The use of excimer conversion has as its principal benefit that a much higher fraction of the decay energy of the isotopic source can be used if that energy is first converted into many lower energy photons that can be guided around or through shielding, that do not experience self-adsorption in the excimer medium, and which are low enough energy that they will not damage the photovoltaic used. In the case of spent nuclear fuel this is potentially critical since spent fuel consists of many different radioactive isotopes with a wide variety of potentially damaging radiations. The fraction of photon energy that goes into electron-hole formation depends on the W value and the band-gap energy of the material. In Table 6 some common semiconductor materials are shown along with their relevant properties. As above, the mean ionization energy required to form one electron-hole pair in a solid is the W-value. The ratio of the band-gap energy (Eg) to the W value is the effective maximum efficiency for producing electron-hole pairs through the interaction of radiation with matter. As can be seen in the last column of Table 6, the electron-hole pair production efficiency has considerable variation from one material to another. Diamond has the highest at 0.442. Thus when ionizing radiation interacts with diamond, 44.2% of the energy goes into electron-hole pair production. 55.8% goes of the energy essentially goes into heat production. If nothing is done to use the electron-hole pairs that are being produced, they will recombine and the energy eventually is transformed into heat by a series of processes.

TABLE 6

Properties for some common semiconductor materials which are useful for direct nuclear energy conversion

| Material | Minimum band-gap ($E_g$) [eV] | Electron drift mobility (μ) [$cm^2$/V-s] | Fano factor (F) | Density (ρ) [g/$cm^3$] | Atomic mass [g/mole] | Molar density [moles/$cm^3$] | Displacement energy ($E_d$) [eV] | Mean ionization energy (W) [eV] | Eg/W |
|---|---|---|---|---|---|---|---|---|---|
| Silicon | 1.12 | 1450 | 0.115 | 2.329 | 28.1 | 0.0829 | ~19 | 3.63 | 0.308 |
| Germanium | 0.68 | 3900 | 0.13 | 5.323 | 72.6 | 0.0733 | 30 | 2.96 | 0.23 |
| Gallium arsenide | 1.42 | 8500 | 0.1 | 5.317 | 144.6 | 0.0368 | 10 | 4.13 | 0.344 |
| Silicon carbide | 2.9 | 400 | 0.09 | 3.22 | 40.1 | 0.0803 | 28 | 6.88 | 0.421 |
| Gallium nitride | 3.39 | 1000 | — | 6.15 | 83.7 | 0.0735 | 24 | 8.9 | 0.381 |
| Diamond | 5.48 | 1800 | 0.08 | 3.515 | 12 | 0.293 | 43 | 12.4 | 0.442 |

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention. The example claims illustrate the scope of example embodiments.

The invention claimed is:

1. An isotope energy recovery system, the system comprising:

a shielded spent nuclear fuel storage cask being sized to contain nuclear fuel rods including the isotope;

reflective surfaces within the storage cask and around the fuel rods;

an excimer medium surrounding the fuel rods in the path of radiation decay from the isotope, wherein the excimer absorbs the radiation decay and emits photons in response;

a photovoltaic cell disposed to receive the photons;

connections external to the storage cask for a load to draw power from the photovoltaic cell.

2. The system of claim 1, wherein the isotope comprises an alpha emitter.

3. The system of claim 2, wherein the isotope consists of an alpha emitter.

4. The system of claim 1, wherein the isotope comprises a beta emitter.

5. The system of claim 4, wherein the isotope consists of an beta emitter.

6. The system of claim 1, wherein said excimer medium comprises a gas excimer.

7. The system of claim 6, wherein said excimer medium comprises a gas plenum contained in said storage cask under pressure.

8. The system of claim 1, wherein said excimer medium comprises a liquid.

9. The system of claim 8, further comprising a lightpipe to isolate said photovoltaic cell and to direct photons toward said photovoltaic cell.

10. The system of claim 1, wherein said excimer medium comprises a solid.

11. The system of claim 1, wherein said storage cask comprises opposite top and bottom ends and said photovoltaic cell is disposed on one of the top and bottom ends of said cask and is shielded with material transparent to photons.

12. The system of claim 1, wherein said photovoltaic cell lines walls of said reflective surfaces.

13. The system of claim 1, further comprising a heat to energy conversion device attached to the storage cask.

14. The system of claim 1, wherein the storage cask is table top sized and the fuel rods are processed to fit with the table top sized storage cask.

15. The system of claim 1, wherein the fuel rods are unprocessed.

* * * * *